US010109934B2

(12) United States Patent
Weiden

(10) Patent No.: US 10,109,934 B2
(45) Date of Patent: Oct. 23, 2018

(54) DIN RAIL LATCHING MEANS

(71) Applicant: Schneider Electric USA, Inc., Andover, MA (US)

(72) Inventor: Conrad S Weiden, Chapel Hill, NC (US)

(73) Assignee: Schneider Electric USA, Inc., Andover, MA (US)

( * ) Notice: Subject to any disclaimer, the term of this patent is extended or adjusted under 35 U.S.C. 154(b) by 0 days.

(21) Appl. No.: 15/384,906

(22) Filed: Dec. 20, 2016

(65) Prior Publication Data

US 2018/0175517 A1 Jun. 21, 2018

(51) Int. Cl.
*H01R 4/64* (2006.01)
*H01R 9/26* (2006.01)
*H01R 25/14* (2006.01)

(52) U.S. Cl.
CPC ..... *H01R 4/64* (2013.01); *H01R 9/2608* (2013.01); *H01R 25/142* (2013.01)

(58) Field of Classification Search
CPC ..... H01R 9/2608; H01R 4/64; H01R 25/142
See application file for complete search history.

(56) References Cited

U.S. PATENT DOCUMENTS 4,921,445 A * 5/1990 Herbert ..... H02B 1/052 439/532
4,947,290 A * 8/1990 Ootsuka ..... H02B 1/052 248/222.13
5,318,462 A * 6/1994 Oakley ..... H01H 85/2045 439/620.34
5,904,592 A * 5/1999 Baran ..... H02B 1/052 361/627
6,456,495 B1 * 9/2002 Wieloch ..... H05K 7/1468 312/215

(Continued)

FOREIGN PATENT DOCUMENTS

EP 1182735 2/2002

OTHER PUBLICATIONS

English Language Machine Translation of European Patent Application Publication No. EP1182735, Publication Date: Feb. 27, 2002, 12 pages.

*Primary Examiner* — Edwin A. Leon
*Assistant Examiner* — Oscar Jimenez
(74) *Attorney, Agent, or Firm* — Locke Lord LLP

(57) ABSTRACT

A DIN rail latching device providing automatic grounding of printed circuit boards inside an electrical device as the electrical device is attached to the DIN rail. The DIN rail latching device includes a stationary section, a movable section and a spring section, all made from a single piece of electrically conductive material. The movable section being moved from a first position wherein the electrical device is secured to the DIN rail by a DIN rail engagement leg of the movable section to a second position wherein the DIN rail engagement leg is retracted such that the electrical device can be removed from the DIN rail. The stationary section being attached to a bottom surface of the electrical device such that it cannot move with respect to the bottom surface. The stationary section also includes a ground stab formed from the stationary section and configured for connecting to a spring type ground terminal of a PCB located inside the electrical device such that removal and installation of PCBs is easily accomplished.

14 Claims, 3 Drawing Sheets

(56) References Cited

U.S. PATENT DOCUMENTS

| | | | | |
|---|---|---|---|---|
| 7,686,626 | B2 * | 3/2010 | Wu | H01R 4/64 439/95 |
| 7,686,627 | B2 * | 3/2010 | Wu | H01R 9/2691 439/95 |
| 7,922,521 | B1 * | 4/2011 | Wu | H01R 9/2691 439/532 |
| 7,980,891 | B2 | 7/2011 | Molnar | |
| 8,014,168 | B2 * | 9/2011 | Lanning | H01R 25/145 248/424 |
| 8,062,061 | B2 * | 11/2011 | Lim | H02B 1/052 439/532 |
| 9,088,080 | B2 * | 7/2015 | Hunt | H01R 4/64 |
| 9,386,718 | B2 * | 7/2016 | Kusumi | H05K 7/14 |
| 2010/0255713 | A1 * | 10/2010 | Peng | H02B 1/052 439/532 |
| 2013/0214109 | A1 * | 8/2013 | Yu | H02B 1/0526 248/298.1 |
| 2014/0017917 | A1 | 1/2014 | Molnar | |
| 2016/0262274 | A1 * | 9/2016 | Molnar | H05K 5/0026 |
| 2016/0295733 | A1 * | 10/2016 | Chiang | H05K 7/12 |

* cited by examiner

DIN RAIL LATCHING MEANS

FIELD OF THE INVENTION

The invention is generally directed to DIN rail mounted electrical devices and particularly to a DIN rail latching device that provides an electrical ground to electrical components inside an electrical device attached to DIN rails.

BACKGROUND OF THE INVENTION

Many electrical components and/or devices are mounted in an enclosure or on a surface by means of a DIN rail. These devices typically have one fixed retaining tab and one spring loaded movable latch that permits a fast and easy installation or removal of the device onto or off of the DIN rail. Movable latches generally do not provide the strength and stability of fixed retaining tabs. Therefore, two fixed retaining tabs would be desirable. There are generally two basic types of spring loaded sliding DIN rail latches. One is located on the bottom of the device being installed, which is usually the "load" side, requires a tool to slide the latch away from the DIN rail for removal, the other is located on the top of the device being installed, which is usually the "line" side of the device, generally does not require a tool for removal but does require the device itself to be manipulated for removal. Those that require a tool are easily understood since the tool engagement area is usually easily seen but those that do not require a tool for removal can be more challenging and in some cases can result in damage to the device if it is not manipulated in the right way. Another problem common in DIN rail mounted electronic devices is grounding of the electronics inside the installed device. In most cases a ground wire or conductor of some type must be connected to the internal electronics and a ground terminal either on the DIN rail or the enclosure in which the DIN rail is installed. Therefore, it would be desirable for a DIN rail mountable device to have both top and bottom fixed retaining tabs, a visible means for unlatching the device for removal and an automatic grounding means for grounding the electronics inside the device. Also, with the current method of repair being the replacement of printed circuit boards (PCBs), it would be desirable for the ground connection to the PCB to be completed automatically as the replacement PCB being installed.

SUMMARY OF THE INVENTION

The present invention provides a method of latching and unlatching a device at the top of a DIN rail that has a visible tool engagement point. The latching means also has fixed retaining tabs at both the top and bottom of the DIN rail. The invention also provides an automatic ground connection between the DIN rail and PCBs inside the attached device. The automatic ground connection also automatically connects replaced PCBs to ground as they are installed.

Therefore, a DIN rail latching device for attaching an electrical device to a DIN rail according to the present invention comprises:

a stationary section attached to a bottom surface of the electrical device such that the stationary section cannot move with respect to the bottom surface of the electrical device;

a movable section configured to move back and forth with respect to the stationary section; and a spring section located between the stationary section and the movable section, the spring section maintaining the movable section in a first position wherein the electrical device is secured to the DIN rail and operatively moving the movable section to a second position wherein the electronic device can be removed from the DIN rail.

This invention provides a rugged, single part DIN rail fixing means that latches and unlatches from the "Line" side of the electronic device along with the obvious release tool provision typical found on "load" side sliding clip designs. This one-piece DIN rail latching device also provides a simple means by which an electrical device can be grounded to the DIN rail without extra parts or operations. Another advantage of this invention is that the spring's DIN rail interface is a stamped metal form that can "bite" into the Din rail unlike a wound steel or plastic spring form. This increases the side to side holding force and improves the electrical connection required for proper DIN rail grounding.

DETAILED DESCRIPTION OF THE EMBODIMENTS

Figure 1:
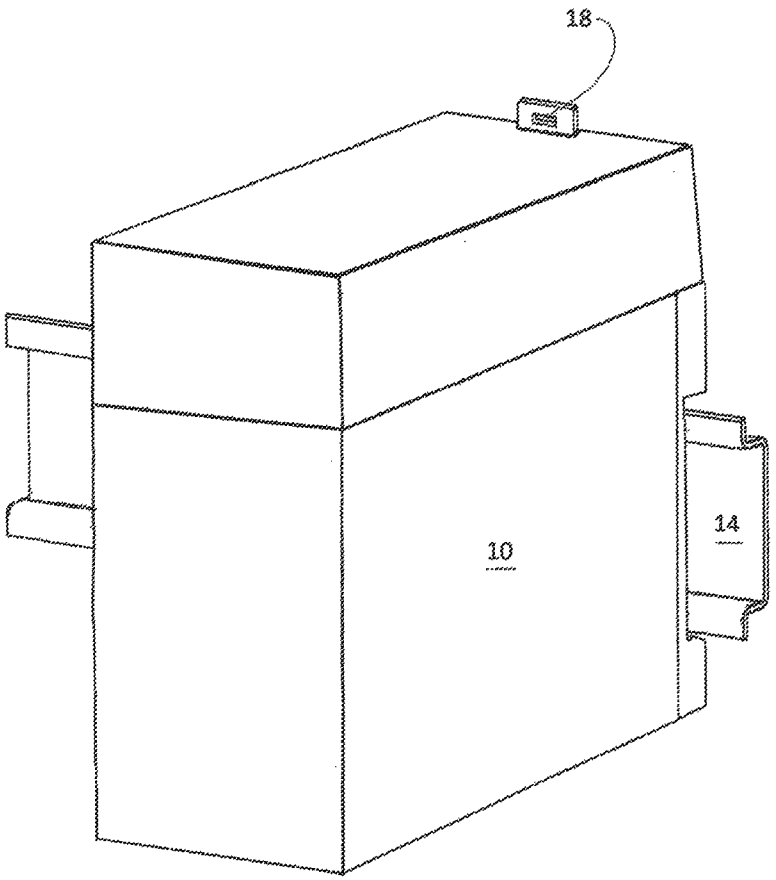
FIG. 1 illustrates an electronic device employing the DIN rail latching device of the present invention.

Referring now FIG. 1, an electronic device 10 is installed on a DIN rail 14. A tool engagement slot 18 is located at the top of the electronic device 10 and easily visible to someone attempting to remove the electronic device 10 from the DIN rail 14.

Figure 2:
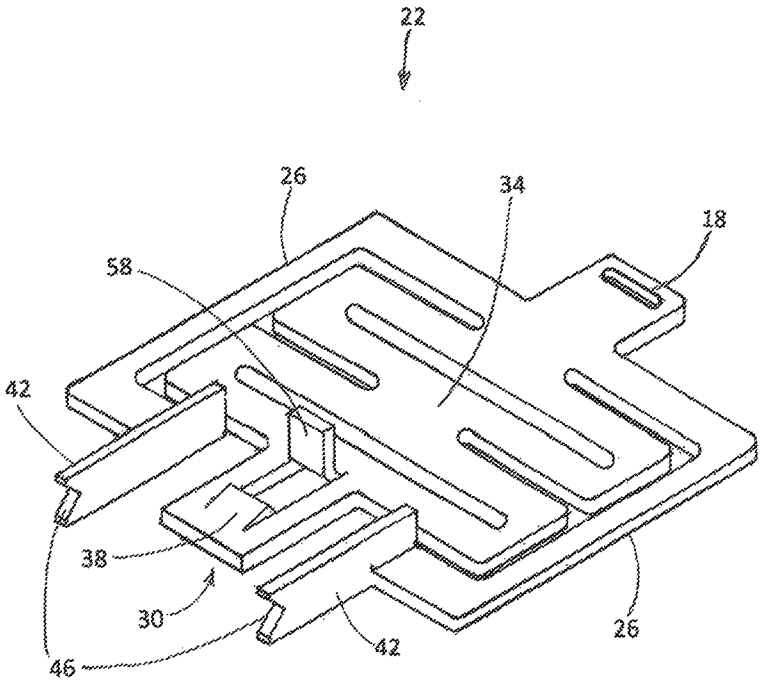
FIG. 2 is an isometric view of the latching device of the present invention.
Figures 3, 4:
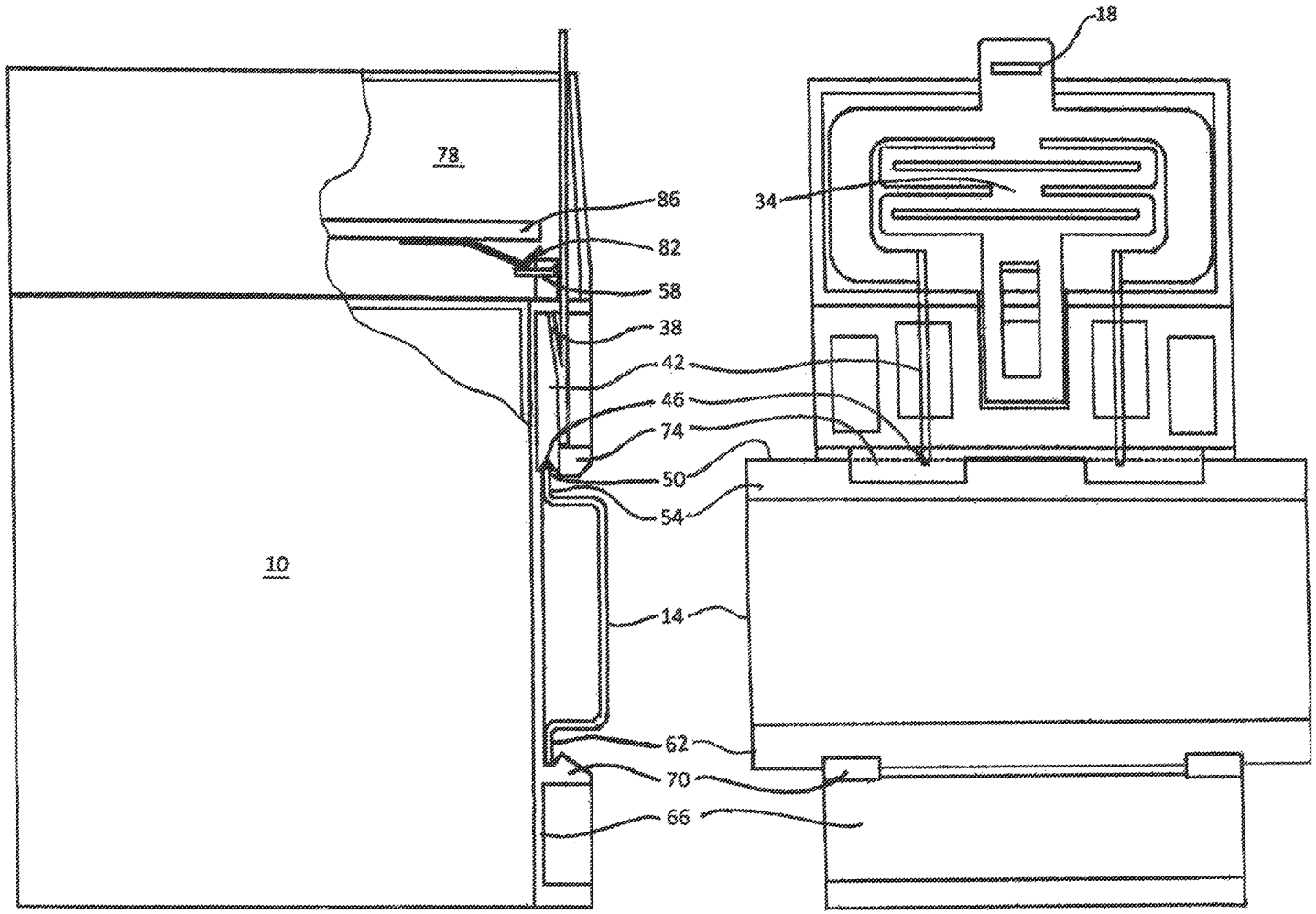
FIG. 3 illustrates a side cutaway view of the electronic device with the latching device in the latched position.
FIG. 4 illustrates a bottom view of the electronic device with the latching device in the unlatched position.

Referring now to FIG. 2, a latching device, generally indicated by reference numeral 22, is shown. The latching device 22 is made from a single piece of a conductive material and includes the tool engagement slot 18, a movable section 26, a stationary section 30 and a spring section 34 located between the movable section 26 and stationary section 30. The latching device 22 can be easily made by methods such as stamping or other well known methods of cutting and/or removing material. The spring section 34 is designed such that movement of the movable section 26 with respect to the stationary section 30 is limited. However, the spring section 34 does permit movement of the movable section 26 between a first position and a second position when a tool such as a screwdriver or other lever type device inserted into the tool slot 18 applies a force directed away from the DIN rail 14 on the tool slot 18. The stationary section 30 is fixed to device 10 by a locking tab 38, or other means, such that it cannot move with the movable section 26. The movable section 26 includes DIN rail engaging legs 42, which have V-shaped notches 46 at their distal ends for engaging the edge 50 of the upper DIN rail flange 54 as shown in FIGS. 3 and 4. A PCB grounding stab 58 is formed from the stationary section 30 such that it extends generally perpendicularly to the generally flat latching device 22.

Referring now to FIGS. 3 thru 6, the operation of the latching device 22 is disclosed. FIG. 3 illustrates, in a side view, the electronic device 10 installed on the DIN rail 14 with the movable section 26 in the first (engaged) position. A lower flange 62 of the DIN rail 14 is seated between the bottom 66 of the electronic device 10 and a lower fixed retaining tab 70 formed from the bottom 66 of the electronic device 10. The locking tab 38 is engaging a portion of the electronic device bottom 66 such that the stationary section 30 of the latching device 22 cannot move with respect to the bottom 66 of the electronic device 10. In the first position of the movable section 26 the V-shaped notches 46 of the DIN rail engaging legs 42 are forced against the edge 50 of the upper DIN rail flange 54 by the spring section 34 of the latch device 22. The forced engagement of the relatively sharp edges 50 of the upper DIN rail flange 54 in the V-shaped notches 46 provides an excellent ground connection between the DIN rail 14 and the latching device 22. The DIN rail engaging legs 42 are slidingly received between the electronic device bottom 66 and upper fixed retaining tabs 74, also formed from the bottom 66 of the electronic device 10, such that the V-shaped notch 46 also functions as a fixed latch. The PCB grounding stab 58 extends into a cavity 78 defined by electronic device 10 such that it can be connected to a ground terminal 82 of a PCB 86 located in the cavity 78. The PCB ground terminal 82 can be a spring device as shown, or any other configuration capable of engaging the PCB grounding stab 58 such that an adequate ground between the PCB grounding stab 58 and the PCB ground terminal 82 is accomplished.

Referring now to FIG. 4, the electronic device 10, installed on the DIN rail 14 as in FIG. 3, is shown from the bottom of the DIN rail 14. The V-shaped notches 46 of DIN rail engaging legs 42 are forcibly engaging the edge 50 of the upper DIN rail flange 54, thereby ensuring that the lower DIN rail flange 62 is seated between the bottom 66 of the electronic device 10 and the lower fixed retaining tabs 70.

Figures 5, 6:
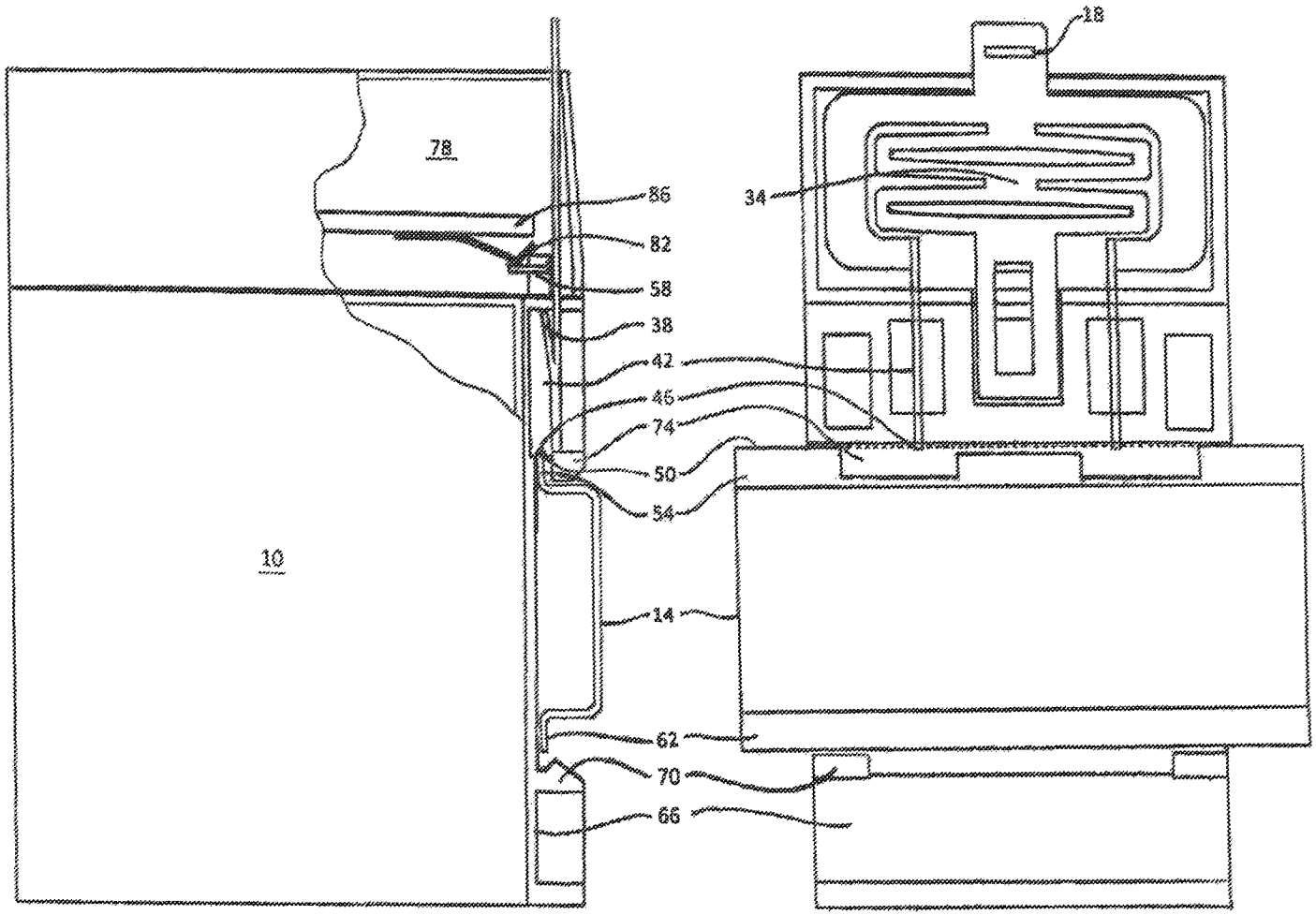
FIG. 5 illustrates a side cutaway view of the electronic device showing the internal ground with the latching device in the unlatched position
FIG. 6 illustrates a bottom view of the electronic device with the latching device in the retracted position

Referring now to FIG. 5, a side view of the electronic device 10 installed on the DIN rail 14 with the movable section 26 in the second (retracted) position is shown. In the second position the DIN rail engaging legs 42 have been retracted by levering the tool engagement slot 18 away from the DIN rail 14. With the DIN rail engaging legs 42 in the second position the electronic device 10 is easily removed from the DIN rail 14 by rotating the electronic device 10 slightly away from the bottom flange 62 of DIN rail 14 until it clears the lower fixed retaining tabs 70 and then upward until the upper flange 54 clears the upper fixed retaining tabs 74.

Referring now to FIG. 6, the electronic device 10, installed on the DIN rail 14 as in FIG. 5, is shown from the bottom of the DIN rail 14. When the DIN rail engaging legs 42 are in their retracted position the spring section 34 is expanded due to the lever force applied to the tool engaging slot 18. With the DIN rail engaging legs 42 in their retracted position the upper DIN rail flange 54 can move upward with the DIN rail engaging legs 42 permitting the lower DIN rail flange 62 to disengage from the lower fixed retaining tabs 70. The electronic device 10 can then be removed from the DIN rail 14 by rotating the electronic device 10 upward and away from the DIN rail the DIN rail engaging legs 42 retracted.

I claim:

1. A DIN rail latching device for attaching an electrical device to a DIN rail comprising:

a stationary section attached to a bottom surface of the electrical device such that the stationary section cannot move with respect to the bottom surface of the electrical device;

a movable section configured to move back and forth with respect to the stationary section;

a spring section located between the stationary section and the movable section, the spring section maintaining the movable section in a first position wherein the electrical device is secured to the DIN rail and operatively moving the movable section to a second position wherein the electronic device can be removed from the DIN rail;

a ground stab, formed from the stationary section and configured for connecting to a PCB located in a cavity defined by the electrical device permitting the PCB to easily be removed and/or replaced if required, the ground stab automatically providing an electrical ground path from the DIN rail to the PCB as the electrical device is attached to the DIN rail; and wherein the stationary section, movable section and spring section are made from a single piece of electrically conductive material.

2. The DIN rail latching device of claim 1, wherein the stationary section is attached to the bottom of the electrical device by a locking tab.

3. The DIN rail latching device of claim 1, wherein the ground stab is configured for connecting to a spring biased or spring clamping ground terminal thereby permitting a PCB to easily be removed and/or replaced if required.

4. The DIN rail latching device of claim 1, wherein the movable section includes a tool slot for receiving a tool capable of levering the movable section away from the DIN rail to the second position.

5. The DIN rail latching device of claim 1, wherein the movable section includes a DIN rail engaging leg having a V-shaped notch at its distal end.

6. The DIN rail latching device of claim 5, wherein the V-shaped notch engages an edge of a DIN rail flange such that a positive electrical connection is made between the DIN rail and the DIN rail engaging leg.

7. The DIN rail latching device of claim 5, wherein the DIN rail engaging leg is supported by a fixed retaining tab such that the engaging leg also becomes a fixed retaining tab.

8. The DIN rail latching device of claim 1, wherein the spring section is configured such that only limited movement of the spring section and movable sections is permitted.

9. A DIN rail latching device for attaching an electrical device to a DIN rail comprising:

a stationary section, being attached to a bottom surface of the electrical device such that the stationary section cannot move with respect to the bottom surface of the electrical device and having a ground stab for connecting to a ground terminal of a PCB inside the electrical device;

a movable section configured to move back and forth with respect to the stationary section;

a spring section located between the stationary section and the movable section, the spring section maintaining a DIN rail engagement leg of the movable section in a first position wherein the electrical device is secured to the DIN rail and operatively moving the DIN rail engagement leg to a second position wherein the electronic device can be removed from the DIN rail; and wherein the stationary section, movable section and spring section are made from a single piece of electrically conductive material.

10. The DIN rail latching device of claim 9, wherein the DIN rail engagement leg is operatively moved to the second position by a tool inserted into a tool slot of the movable section for levering the movable section and DIN rail engagement leg away from the DIN rail such that the DIN rail engagement leg can momentarily reach the second position for removal of the electrical device from the DIN rail.

11. The DIN rail latching device of claim 9, wherein the DIN rail engaging leg has a V-shaped notch at its distal end for engaging an edge of a DIN rail flange such that a positive electrical connection is made between the DIN rail and the DIN rail engaging leg.

12. The DIN rail latching device of claim 9, wherein the DIN rail engaging leg is supported by a fixed retaining tab such that the engaging leg also becomes a fixed retaining tab.

13. The DIN rail latching device of claim 9, wherein the ground stab is configured for connecting to a spring biased or spring clamping ground terminal thereby permitting a PCB to be easily removed and/or replaced if required.

14. The DIN rail latching device of claim 9, wherein the spring section is configured such that only limited movement of the spring section and movable sections is permitted.

* * * * *